US005339715A

United States Patent [19]

Coleman

[11] Patent Number: 5,339,715

[45] Date of Patent: Aug. 23, 1994

[54] PROGRAMMABLE PRESSURE CONTROL SYSTEM

[75] Inventor: Derek I. Coleman, Cobourg, Canada

[73] Assignee: Davidson Textron Inc., Dover, N.H.

[21] Appl. No.: 114,920

[22] Filed: Sep. 2, 1993

[51] Int. Cl.[5] ..... B26F 3/00

[52] U.S. Cl. ..... 83/53; 83/177

[58] Field of Search ..... 83/53, 177, 76.1; 239/101, 533.1; 241/301

[56] References Cited

U.S. PATENT DOCUMENTS

| | | | |
|---|---|---|---|
| 3,930,616 | 1/1976 | Winter | 239/101 |
| 4,246,838 | 1/1981 | Pulver et al. | 83/177 X |
| 4,594,924 | 1/1986 | Windisch | 83/53 X |
| 4,786,848 | 11/1988 | Nickerson | 318/577 |
| 4,934,111 | 6/1990 | Hashish et al. | 83/53 X |

FOREIGN PATENT DOCUMENTS

| | | | |
|---|---|---|---|
| 296879 | 12/1991 | Fed. Rep. of Germany | 83/177 |
| 4040637 | 2/1992 | Japan | 83/177 |
| 1625603 | 2/1991 | U.S.S.R. | 83/177 |

*Primary Examiner*—Richard K. Seidel
*Assistant Examiner*—Kenneth E. Peterson
*Attorney, Agent, or Firm*—Reising, Ethington, Barnard, Perry & Milton

[57] ABSTRACT

A system for controlling the liquid pressure for a liquid cutting dispenser includes an intensifier for producing a predetermined constant pressurized liquid through a conduit to the cutting dispenser. A plurality of reducing dispensers are connected to the conduit and selectively controlled to reduce the pressure from the predetermined pressure of liquid. By actuating different combinations of reducing dispensers having different jewel sizes, variable pressures are obtained. The selection and duration of the reducing dispensers are programmed into memory along with a path a robot is to follow to allow automated cutting with variable pressures.

11 Claims, 2 Drawing Sheets

PROGRAMMABLE PRESSURE CONTROL SYSTEM

TECHNICAL FIELD

The invention relates to a cutting and trimming apparatus, and more particularly to a non-contact trimming apparatus having a robot system operated by multi-axis drive means to position a cutting head on a preprogrammed path to direct a cutting stream of variable pressure against a workpiece.

BACKGROUND OF THE INVENTION

An apparatus for high volume, accurate cutting of both hard and soft materials using a fluid jet cutting device is well known in the art. Furthermore, the use of controlled cutting systems having omni-directional capability using water as a cutting agent are also commonly known as set forth in U.S. Pat. No. 4,786,848, issued Nov. 22, 1988 in the name of Nickerson, and assigned to the assignee of the subject invention. In this technology, a stream of high pressure water is utilized to remove excess material from the workpiece or part being processed. Such water jet cutting systems have successfully been used to cut materials such as composites, corrugated paper board, asbestos, asphalt-based materials, foamed plastics, rubber, nylon, mineral fibers, fiberglass and fiberglass-reinforced plastics, high pressure laminates, plywood, chips in board, poly-ethylene sheet, apparel and automobile fabrics, and food and confectionery products.

The basic components of the water jet process includes directing clean water flow to a booster pump, through filters, into an intensifier, through tubes and swivels, thence to a cutting nozzle. The pressurization of the water is obtained by using fluid pressure intensifier principles. This principle is best illustrated by the force equilibrium of a double-acting piston having a piston end and two smaller diameter plungers. Hydraulic oil pressure acting on the piston results in a force on the plunger that pressurizes water in a small diameter chamber. Since the intensification ratio is constant by virtue of the fixed piston to plunger diameter ratio, water pressure can be regulated by controlling the hydraulic oil pressure. The booster pump has a 10, 5 and 1 micron filter and pumps the water to 190 PSI to preload the pump or intensifier high pressure cylinders. A cutter nozzle arrangement usually consists of a pneumatically controlled shut-off valve, nozzle tube, a jewel orifice and a stainless steel holder and nozzle nut.

In this construction, a workable constant cutting pressure must cut the workpiece within the predetermined required cycle time to meet production volume, plus achieve the quality standards of the cut workpiece. The value of the workable cutting pressure is determined by a balance of constant and variable factors that govern the design of the application program including material type; material thickness versus constant cutting pressure, cycle time, and jewel orifice size; cut quality standard versus constant cutting pressure and cycle time; cycle time versus constant cutting pressure and jewel orifice size; and jewel orifice size versus constant cutting pressure. Since the workable constant cutting pressure will be set to produce desired cut standards through most of the workpiece, there can be variations in thickness or material types in the workpiece that can result in lesser cut quality. Examples of other variables that can affect cut quality include cycle time that is restricted due to insufficient cutting pressure in some areas; further, quality can be adversely affected in some areas due to selecting a constant cutting pressure that is an excessive pressure for a particular cut. These problems have been especially pronounced in the past because water jet cutting apparatus has been unable to produce variable pressure jets matched to different cutting requirements on a single workpiece. In such prior apparatus, the cycle time can be restricted by insufficient cutting pressure, i.e., slower machine feed rates in the thicker areas to obtain a clean cut, and increased feed rates in thin, long straight areas. Furthermore, cut quality can be affected by excessive cutting pressure, i.e., slower machine rates for detail areas or induced water saturation can occur in some applications. Such saturation can cause workpiece delamination and/or staining, and scoring of substrate backing in composite workpieces.

SUMMARY OF THE INVENTION

The invention is a liquid jet cutting apparatus for cutting workpieces by dispensing pressurized liquid to produce high quality cuts in a workpiece having different cutting requirements. The apparatus includes pressure pump means for receiving a liquid and for pressurizing the liquid to a predetermined pressure that produces a pressurized liquid output. Also included is cutting dispenser means having a liquid input for receiving the pressurized liquid output of the pump means. The cutter dispenser means has an output for producing a selected pressurized water jet to cut the workpieces. The apparatus is characterized by including pressure reducing means connected between the pressure pump means and the cutting dispenser means for receiving and selectively reducing the pressure of the pressurized liquid communicated to the cutting dispenser means.

More particularly, the pressure reducing means comprises a plurality of reducing dispensers connected which are selectively actuated to alter the pressure to the cutting dispenser means. Controller means is operatively connected to the cutting dispenser means and the reducing dispenser to selectively control the pressure to the cutting dispenser means by activating certain reducing dispensers, and for controlling the cutting path of the cutting dispenser means.

The apparatus provides reduced cycle time by allowing sufficient and variable pressure to cut thick and thin areas at increased feedrates. Furthermore, cut quality is maintained at desired standards by allowing reduced pressure when cutting workpiece areas that can be adversely affected by higher cutting pressures.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
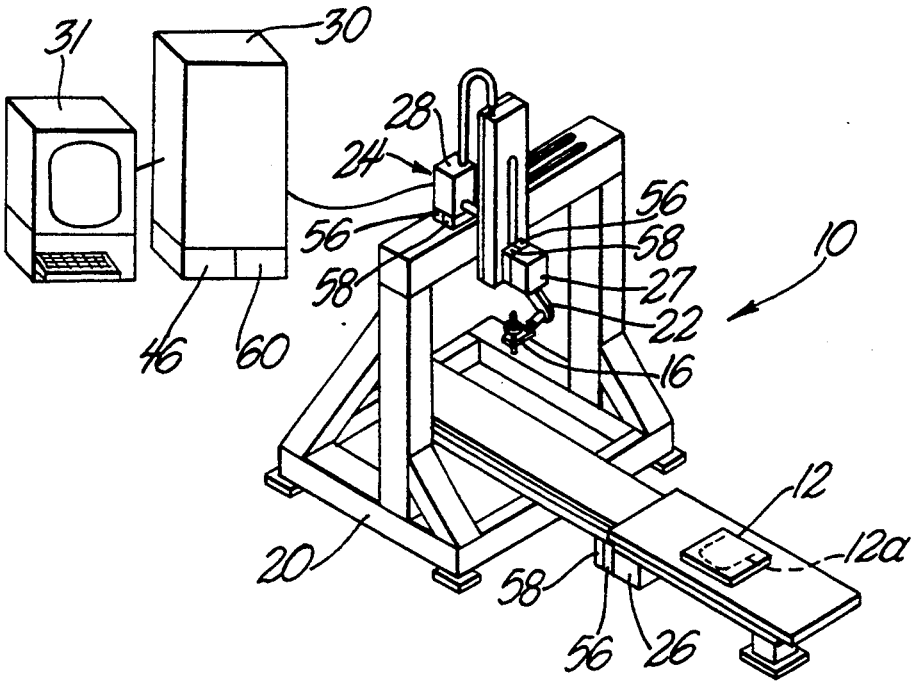
FIG. 1 is a perspective view of the subject invention.

A liquid jet cutting apparatus for cutting materials or workpieces 12 by dispensing pressurized liquid 14 is generally illustrated at 10 in FIG. 1. Apparatus 10 includes cutting dispenser means 16 having a liquid input for receiving a pressurized liquid and an output producing the pressurized water jet 14 for cutting the workpiece 12. The apparatus 10 is capable of controlling the positioning of the cutting dispenser means 16 along three axes to position same with respect to a workpiece 12.

Referring to FIG. 1, the apparatus 10 includes a base 20 supporting a robot arm 22 driven by a three axes drive system 24 including x, y, and z servo motors 26, 27, 28. The servo motors 26, 27, 28 are controlled by a machine controller 30. This system may be of the type disclosed in U.S. Pat. No. 4,786,848, set forth in the background of the invention and assigned to the assignee hereof, and is incorporated by reference herein. The controller 30 generally comprises any type of computer capable of producing control outputs to the motors 26, 27, 28 and input of programming information. In the preferred embodiment, the controller 30 is of the type Allen Bradley 8400 GPC which includes an input and display terminal 31. Programs are input during a teach mode to the controller 30 which identify the coordinate points of the path that the dispenser means 16 will follow as directed by the robot arm 22.

A central processor unit board (CPU) 46 receives position data that carries signals of robot arm position for each of the three axes servo motors 26, 27, 28 as well as the position axis, $720°=\alpha$ and $540°=\beta$, which are driven by servo motors (not shown) to operate a wrist assembly on the robot arm 22 to produce wrist rotation and wrist bending motions respectively, also set forth in the reference patent.

Each of the aforementioned servo motors 26, 27, 28 include a tachometer 56 and an encoder 58. The tac signals for the tachometers 56 control motor currents on conductors connected between the controller 30 and motors 26, 27, 28. A speed control signal controls the current to various motors 26, 27, 28 to position the cutting dispenser means 16 along a desired trim path. The speed signal is established by the CPU board 46 in accordance with parts programs maintained and stored in memory unit 60.

The parts program in the memory 60 may be that set forth in the referenced patent. The pattern of points thereof are marked on a master workpiece 12 and technicians place the controller 30 in either teach mode, or may manually input the coordinate points. The above description of the apparatus 10 is commonly known in the art as set forth in the referenced patent, and therefore is not further described.

Figure 2:
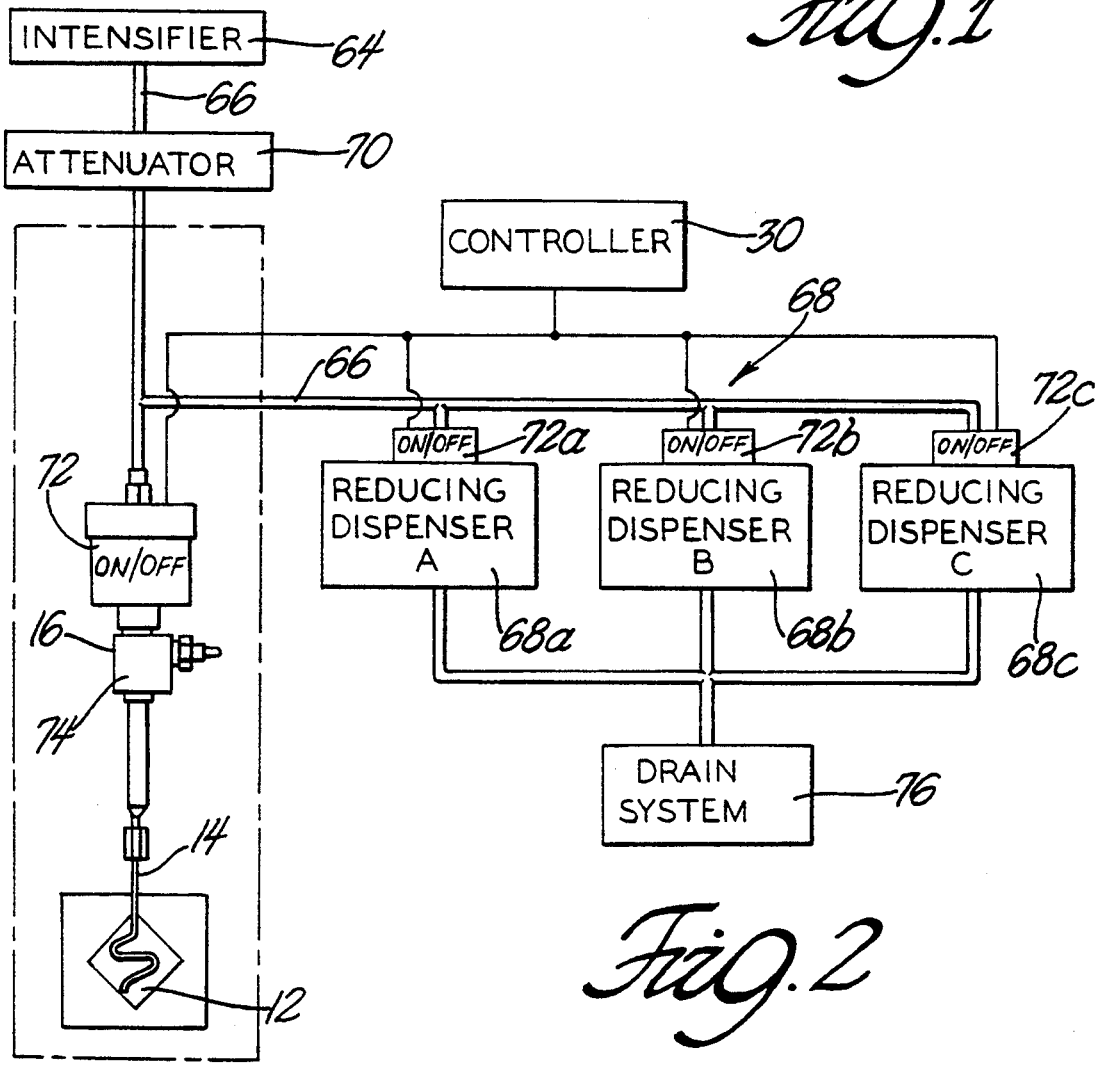
FIG. 2 is a schematic view of the jet cutting portion of FIG. 1.

FIG. 2 illustrates the present invention of the liquid dispensing portion of the apparatus 10. In accordance with the present invention, the apparatus 10 is capable of changing the cutting fluid pressure at designated locations or points along the path with respect to different workpieces 12 and workpieces having different cut requirements along the trim path of the workpiece (diagrammatically shown at 12*a* in FIG. 2).

Pressurizing means 64 receives a liquid and pressurizes the liquid to a predetermined pressure producing a pressurized liquid at a pressure output thereof. In particular, the pressurizing means is an intensifier 64 for receiving the liquid or water from a source, and pressurizing same. The intensifier 64, as commonly known in the art, generally is a double acting piston controlled by hydraulic oil pressure acting on the piston for producing high pressure on a plunger located within a smaller diameter cylinder. In one embodiment, the type is a Flow Systems Incorporated of the Type Flow 6x or 9x models, or alternatively Ingersoll-Rand Equipment. The intensifier 64 produces a constant pressure fluid stream through a conduit 66.

Liquid conduit means 66 connects the intensifier 64 to the cutting dispenser means 16 to transfer the pressurize liquid thereto. The liquid conduit means 66 may be any suitable conduit or piping interconnecting the parts to one another.

An attenuator 70 may be connected at the output of the intensifier 64 in the conduit 66 in order to attenuate any differential in liquid pressure during switching of the output lines from the intensifier 64. This is also commonly known in the art and commonly available. The attenuator 70 can be installed to reduce any pulsating effect if another apparatus 10 is connected to the same intensifier.

The cutting dispenser means 16 generally includes a jewel type orifice 74 formed from material such as sapphire. In one embodiment, the dispenser means 16 is a unit sold by Flow International Corporation, as Type Number 003859-1, as exemplary of the type of device utilized. The dispenser 16 includes an internal on/off valve 72 attached to the orifice 74 for controlling liquid flowing thereto.

The apparatus 10 is characterized by including pressure reducing means 68 connected to the liquid conduit 66 for receiving and selectively reducing the pressure of the pressurized liquid to the cutting dispenser means 16. The pressure reducing means 68 includes a plurality of reducing dispensers 68*a–c* for selectively reducing the pressure of pressurized liquid to selective, differing pressure levels upon the combination of activated reducing dispensers 68*a–c*. Each of the reducing dispensers 68*a–c* is interconnected by the conduit 66 to the intensifier 64, or attenuator 70 when used. The reducing dispensers 68*a–c* are also of the same type as the cutting dispenser 16 and similarly include individual on/off valves 72*a–c*. The jewel or orifice size of the opening from each reducing dispenser 68*a–c*, may be selectively determined for each dispenser 68*a–c* which in turn establishes the controlled pressure at the cutting dispenser 16. It is preferable to utilize a different jewel size for each reducing dispenser 68*a–c* to obtain various pressures.

It has been discovered that when high pressure piping or fittings leak, the intensifier 64 continues to maintain the pressure to which it is set. The pressure at the cutting dispenser 16 will be reduced by a factor that is governed by the size of the leak. If the size of the leak remains constant, the reduced pressure of the cutting dispenser 16 is held constant. Therefore, the apparatus 10 utilizes the reducing dispensers 68*a–c* to establish selectable programmable variable cutting pressures. Instead of controlling the high pressures by restricting it, the apparatus 10 controls the pressure by establishing the amount of "leakage" through a controlled activation of the reducing dispensers 68.

Depending on the varying degrees of material thickness of a workpiece 12, the apparatus 10 would include one or more jewel type reducing dispensers 68*a–c*. The pressure reducing dispensers 68*a–c* are located close to the cutting dispenser 16 and are connected to a drain in system 76 which collects the dispensed liquid or "leakage".

An apparatus 10 installed with two pressure reducing dispensers 68*a–b* will define four control pressures at dispenser 16 depending upon whether none, a selected one, or both reducing dispensers are activated. Three pressure reducing dispensers 68*a–c* can be activated selectively, to create eight different programmable cutting pressures at dispenser 16. It is understood, however that any number of reducing dispensers can be utilized depending upon the variable pressure requirements of a given apparatus 10. When the intensifier 16 is set to the maximum pressure (no leakage) required to quickly cut the thickest area on the workpiece, different jewel sizes in each of the pressure reducing dispensers can be experimented with to yield the ideal cutting pressure for any other workpiece area, when one or more reducing dispensers 68*a–c* are activated. Therefore, the cycle time on any workpieces 12 can be reduced by using an ideal pressure to cut thick areas with decreased feed rates, and another ideal pressure to cut thin long run straight areas with increased feed rates. The quality is also improved by reducing pressure in areas of concern such as areas that can be delaminated by water saturation or areas that can be stained or scored.

The controller 30 is connected to the on/off valves 72, 72*a–c* of the cutting dispenser 16 and the reducing dispensers 68*a–*68*c* for selecting the pressure of liquid to the cutting dispenser 16 based upon control and activation of a combination of the reducing dispensers 68*a–c*. The memory 60 containing the path point coordinates can also be programmed with pressure settings that will activate the controller 30 to establish different pressures at different coordinate points or for different parts or workpieces 12 by turning on and off the control valves 72*a–c* to regulate leakage through the reducing dispensers 68*a–c*.

In one illustrative example, the intensifier 64 is set to 40,000 psi (water). Three reducing dispensers 68*a–c* are utilized having jewel diameters in centimeters of A=0.005 B=0.010 C=0.020. The cutting dispenser 16 has jewel size of 0.007. Therefore, when none of the reducing dispensers 68*a–c* are activated, the reducing jewel total is zero and the effective cutting psi at the cutting dispenser is 3–40K; when reducing dispenser A only is activated, the reducing jewel total is 0.005 and the cutting psi is 35–38K; when only dispenser B is activated, the reducing jewel effective diameter total is 0.010, and the effective cutting psi is 30K–35K; when both A and B reducing dispensers are activated, the reducing jewel effective diameter is 0.015 cm and the effective cutting psi is 25–30K; when only the C reducing dispenser is activated, the jewel total is 0.020 and the effective cutting psi is 20–25K; when A and C reducing dispensers are activated, the jewel effective diameter is 0.025 and the effective cutting psi is 15–20K; when both the B and C reducing dispensers are activated the jewel effective diameter is 0.030 and the effective cutting psi is 10–15K; and when all of the reducing dispensers are activated, the reducing jewel effective diameter is 0.035 and the effective cutting psi is 5–10K The controller 30 controls the pressure of the cutting dispenser 16 by selectively controlling the valves 72*a–c* of the reducing dispensers 68*a–c* to any combination of on and off as discussed above to obtain the desired cutting pressures. After the controller 30 is taught the paths or points for robot control, the programmer will thereafter input a single pressure for each part program if the pressure is constant for the entire part, or can specify change pressure points corresponding to each or selective path points for the part program. The pressure may be specified in terms of digital control, i.e., on=1 or off=1, such as A=1, B=1, C=0 for A and B dispensers on and C dispenser off to provide a pressure of 25–30K psi in the above example.

An example of a portion of a part program stored in memory 60 incorporating the invention may include the following parameters:

| | Part X: | |
|---|---|---|
| coordinates (x, y, z) | speed (cm/sec) | pressure (A, B, C dispensers) |
| 0, 0, 0 | 0.1 | 0, 0, 0 |
| 0, 2, 0 | 0.1 | 0, 0, 1 |
| 2, 4, 0 | 0.02 | 1, 1, 1 |

In this example, the robot starts at the coordinates 0, 0, 0 of the workpiece 12 and moves at a speed of 0.1 cm/sec at a pressure of 0, 0, 0 =40K psi to the coordinates 0, 2, 0. At this latter coordinate, the pressure changes to 0, 0, 1 =20–25K psi and the robot moves the cutting dispenser 16 to coordinates 2, 4, 0; etc.

Figure 3:
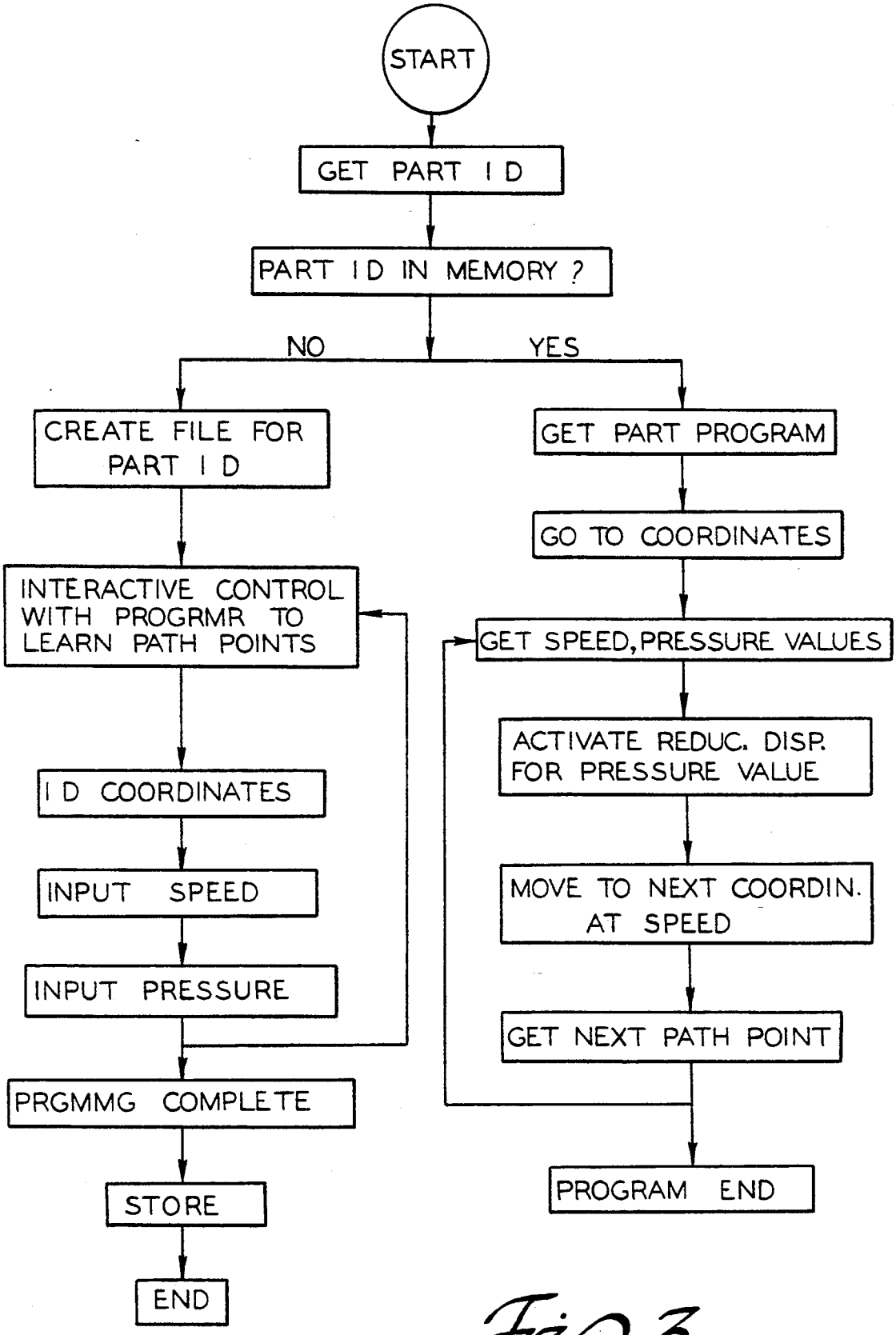
FIG. 3 is a flow chart for operating the controller of FIG. 1 and 2.

The controller 30 implements the flow chart of FIG. 3. If a particular part does not include a part program in memory 60, a program must be created by teaching the controller 30 the coordinates and inputting the speed and pressure values. If a program has already been created for the part identification number, the robot acts on the part according to the coordinates, speed and pressure values stored within the program.

Also included is a method of cutting workpieces by pressurized liquid. The method includes the steps of pressurizing a liquid to a predetermined constant pressure producing a pressurized liquid through a conduit, receiving and selectively reducing the pressure of the liquid from the predetermined pressure thereby reducing the pressure of liquid through the conduit, and producing a cutting water jet at the reduced pressure to cut the workpiece. Also included is selectively controlling the reduction of the pressure to one of a plurality of pressures and including reducing the pressure of the pressurized liquid by connecting a plurality of reducing dispensers in the conduit to the drain system and selectively operating the reducing dispensers to selectively control the pressure of liquid for the cutting.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A liquid jet cutting apparatus for cutting workpieces by dispensing pressurized liquid, said apparatus comprising:

pressure pump means for receiving a liquid and pressurizing the liquid to a predetermined pressure producing a pressurized liquid at a pressure output thereof;

cutting dispenser means having a liquid input for receiving said pressurized liquid and an output for producing a selected pressurized water jet to cut the workpiece;

pressure reducing means connected between said pressure pump means and said cutting dispenser means for receiving and selectively reducing the pressure of said pressurized liquid communicated to said cutting dispenser means, said pressure reducing means including a plurality of reducing dispensers for selectively reducing the pressure of said pressurized liquid to one of a plurality of selective pressures based upon the combination of activated and deactivated reducing dispensers.

2. An apparatus as set forth in claim 1 wherein each of said reducing dispensers include a jewel-type nozzle dispenser.

3. An apparatus as set forth in claim 1 further including controller means operatively connected to each of said cutting dispenser means and said reducing dispensers for selectively controlling the pressure of liquid to said cutting dispenser means based upon control and activation of said reducing dispensers.

4. An apparatus as set forth in claim 3 wherein said controller means includes memory means for storing a plurality of coordinate points and a plurality of pressure values to control said cutting dispenser means along a path established by said coordinate points and to control said reducing dispensers to produce the selected pressure at said cutting dispenser means.

5. An apparatus as set forth in claim 3 wherein each of said pressure reducing means includes an on/off valve operatively controlled by said controller means for selectively controlling the pressure of liquid to said cutting dispenser.

6. An apparatus as set forth in claim 1 further including liquid conduit means for connecting said pressure pump means to said cutting dispenser means, said pressure reducing means connected to said conduit means for adjusting the pressure to said cutting dispenser means.

7. A method of cutting workpieces by pressurized liquid, the method including the steps of:

pressurizing a liquid to a predetermined constant pressure producing a pressurized liquid through a conduit;

receiving and selectively reducing the pressure of the liquid from the predetermined pressure thereby reducing the pressure of liquid through the conduit;

producing a cutting water jet at the reduced pressure to cut the workpiece;

selectively controlling the reduction of the pressure to one of a plurality of pressures;

and reducing the pressure of the pressurized liquid by connecting a plurality of dispensing nozzles in the conduit and selectively operating the dispensers to selectively control the pressure of liquid for the cutting.

8. A liquid jet cutting apparatus for cutting workpieces by dispensing pressurized liquid, said apparatus comprising:

pressure pump means for receiving a liquid and pressurizing the liquid to a predetermined pressure producing a pressurized liquid at a pressure output thereof;

cutting dispenser means having a liquid input for receiving said pressurized liquid and an output for producing a selected pressurized water jet to cut the workpiece;

pressure reducing means connected between said pressure pump means and said cutting dispenser means for receiving and selectively reducing the pressure of said pressurized liquid communicated to said cutting dispenser means;

said pressurizing means comprising means for leaking off and redirecting a portion of said pressurized liquid from said input to said cutting dispenser means to selectively reduce pressure of said pressurized liquid to said cutting dispenser means to one of a plurality of selective pressures.

9. An apparatus as set forth in claim 8 wherein said means for leaking off and redirecting a portion of said pressurized liquid comprises at least one selectively operable dispenser connected to said conduit to open and close to selectively decrease the pressure of liquid for the cutting.

10. A method of cutting workpieces by pressurized liquid, the method including the steps of:

pressurizing a liquid to a predetermined constant pressure producing a pressurized liquid through a conduit;

receiving and selectively reducing the pressure of the liquid from the predetermined pressure thereby reducing the pressure of liquid through the conduit;

producing a cutting water jet at the reduced pressure to cut the workpiece, selectively controlling the reduction of the pressure to one of a plurality of pressure by reducing the pressure of the pressurized liquid in the conduit by leaking off a portion of said pressurized liquid from the cutting water jet.

11. A method as set forth in claim 10 further including connecting at least one selectively operable dispenser in the conduit to selectively decrease the pressure of liquid.

* * * * *